United States Patent [19]

Okada et al.

[11] 4,197,003

[45] Apr. 8, 1980

[54] SWITCH DEVICE IN ELECTROSTATIC PHOTOGRAPHIC COPYING MACHINE

[75] Inventors: Tetsuya Okada, Takatuki; Tadashi Umeda, Gosho; Masahiro Murakami, Shijonawate; Tatsuo Aizawa, Osaka, all of Japan

[73] Assignee: Mita Industrial Co., Ltd., Osaka, Japan

[21] Appl. No.: 929,812

[22] Filed: Jul. 31, 1978

[30] Foreign Application Priority Data

Jul. 30, 1977 [JP] Japan ..... 52-92015
Dec. 6, 1977 [JP] Japan ..... 52-146949

[51] Int. Cl.[2] ..... G03G 15/00
[52] U.S. Cl. ..... 355/3 R; 355/8
[58] Field of Search ..... 355/14, 8, 3 R

[56] References Cited

U.S. PATENT DOCUMENTS 3,951,544 4/1976 Mikasa ..... 355/14 X
4,027,965 6/1977 Mikasa et al. ..... 355/14 X

*Primary Examiner*—R. L. Moses
*Attorney, Agent, or Firm*—Wenderoth, Lind & Ponack

[57] ABSTRACT

A switch device for an electrostatic photographic copying machine having a reciprocally movable member reciprocating from a rest position and returning thereto during each copying operation of the copying machine, and a drive driving the movable member. The switch device has an actuating member movable relative to the copying machine body and is toward a non-operating position. An operating member engages with the actuating member for moving it to an operating position. A retaining device engages the actuating member for holding the actuating member in the operating position after it has been moved to the operating position. A switch actuating the drive for the movable member is engageable by the actuating member for actuating the drive means when the movable member is in the operating position and actuating the switch for deactuating the drive when the movable member is in the non-operating position. A protuberant member movable with the reciprocally movable member engages the retaining device just prior to the return of the reciprocally movable member to the rest position after a reciprocating movement thereof for disengaging the retaining device from the actuating member, whereby when the retaining means is disengaged the actuating member is free to be moved to the non-operating position for actuating the switch for deactuating the drive.

12 Claims, 11 Drawing Figures

SWITCH DEVICE IN ELECTROSTATIC PHOTOGRAPHIC COPYING MACHINE

This invention relates to a switch device in an electrostatic photographic copying machine.

Conventionally, an electrostatic photographic copying machine has a switch to start a movable member, e.g., a supporting member for an original which reciprocates once for each one copy and another separate switch associated with the starting switch to stop the movable member at a required position, both the switches being connected in an electric circuit, thereby controlling movement of the movable member. Such an arrangement has the drawback that the electric circuit is complex and the movable member is precisely controlled.

This invention is directed to a single switch device for an electrostatic photographic copying machine replacing the usual two switches for starting and stopping the movable member, the switch being turned ON for starting copying and OFF when the movable member returns to its stop position. An object of the invention is the provision of such a switch device with mechanical construction which is simple and which is reliable in operation.

BRIEF DESCRIPTION OF THE DRAWINGS

The invention will be described in detail in the following specification taken with the accompanying drawings, in which.

DETAILED DESCRIPTION OF THE INVENTION

Figure 1:
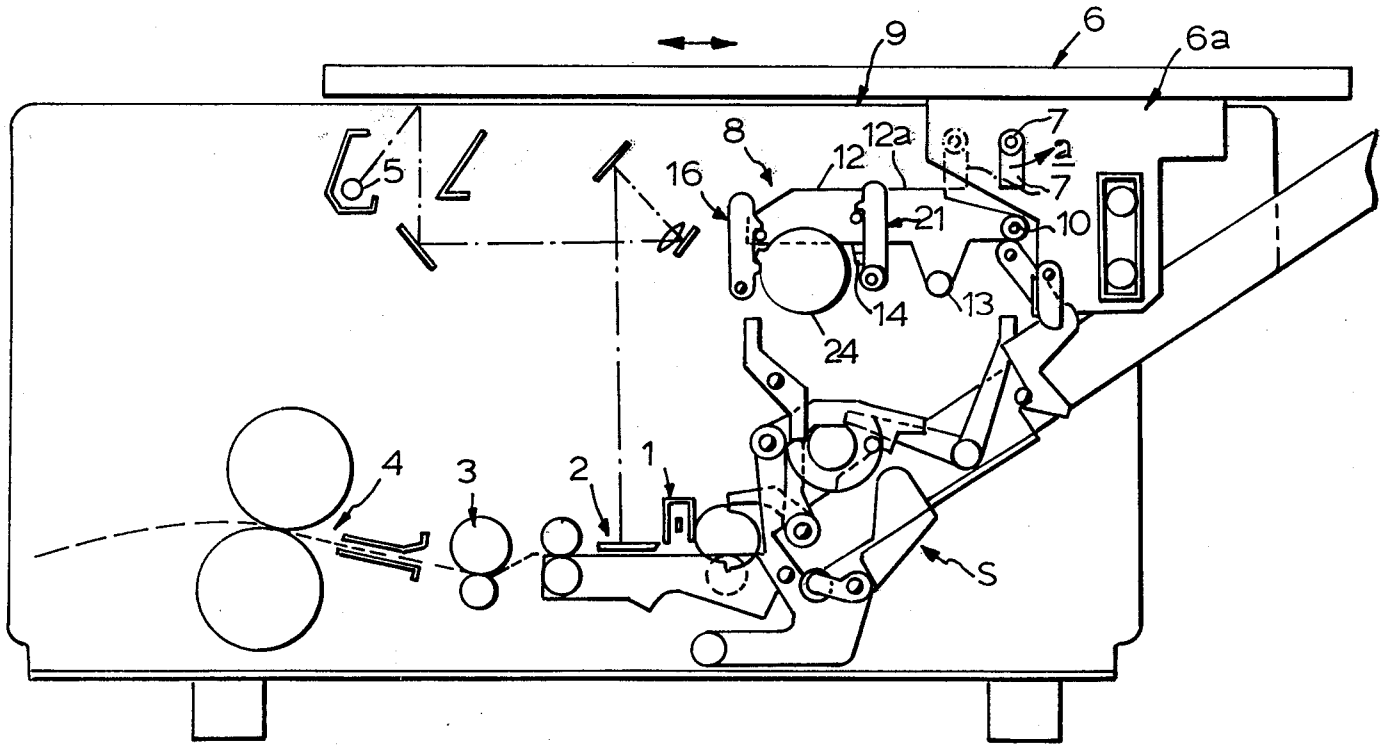
FIG. 1 is a general schematic view of an electrostatic photographic copying machine utilizing the switch device according to this invention.

One type of electrostatic photographic copying machine which has a movable member as the supporting member for an original and with which the switch of the present invention can be used is shown in FIG. 1, and has a copy sheet supplying mechanism S, a charging station 1, an exposure station 2, a developing station 3, a fixing station 4, a light source 5, a supporting member 6 for an original, a slide frame 6*a* secured to said supporting member 6, a protuberant member 7 pivotally secured to said slide frame 6*a* by a pin 7′ so as to be swingable only in the direction of arrow a, and a switch mechanism 8 according to the invention. The structural arrangement of the elements of the switch mechanism is in detail in FIGS. 2 to 4.

Figure 2:
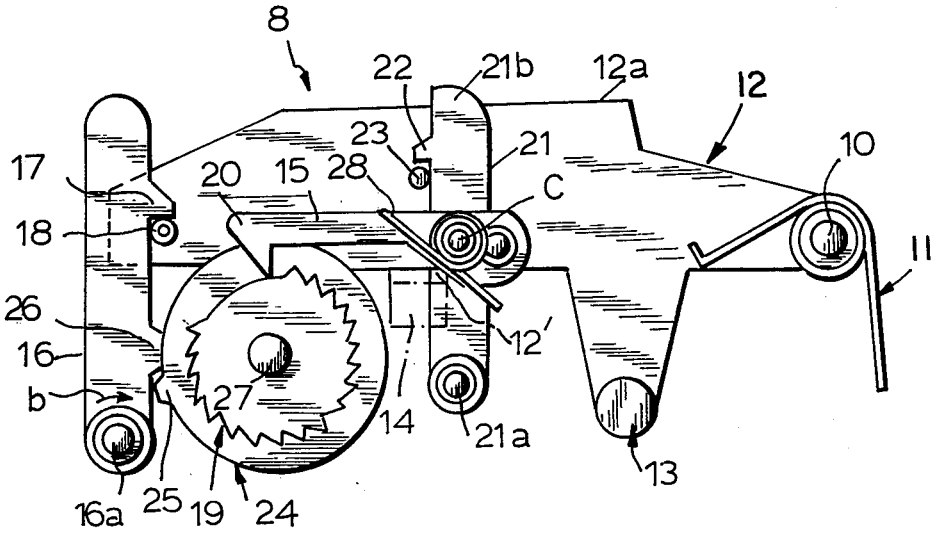
FIG. 2 is a front view of a first embodiment of the switch device of the invention.

Referring to FIG. 2, the switch mechanism 8 comprises an actuating member 12 pivotally secured to the machine frame 9 by a pivot 10 and urged toward a determined position (the inactive position shown by the solid lines in FIG. 3) by a spring 11, an operating means 13 for swinging said actuating member 12 from the position shown in the solid lines in FIG. 3 to the position shown in FIG. 2 to cause said actuating member 12 undergo a positional change at the start of the copying operation, a retaining means (described later) for retaining the member 12 in the active position after said positional change, a switch 14 which is turned ON upon said positional change of the actuating member 12 to start the copying operation by moving said supporting member 6, and a counter mechanism 15 which is operated by the forward movement (movement to the right in the drawing) of said protuberant member 7 to count the number of reciprocations of the supporting member 6.

The top edge 12*a* of said actuating member 12 is so designed that said protuberant member 7 will reciprocate while sliding on said top edge 12*a* when said actuating member 12 has moved to the position shown in FIG. 2. Retaining means for retaining the actuating member 12 in position after said positional change is provided in the form of a hooked portion 17 on a lever 16 pivotally secured to the machine frame 9 by a pivot 16*a* and normally urged in a given direction (the direction of arrow b in FIG. 2) by a spring means (not shown), whereby when the actuating member 12 is changed from the position shown by the solid lines in FIG. 3 to the position of FIG. 2, a protuberance 18 provided on the actuating member 12 is engaged with said hooked portion 17 to thereby retain the actuating member 12 in the changed position.

Figure 5:
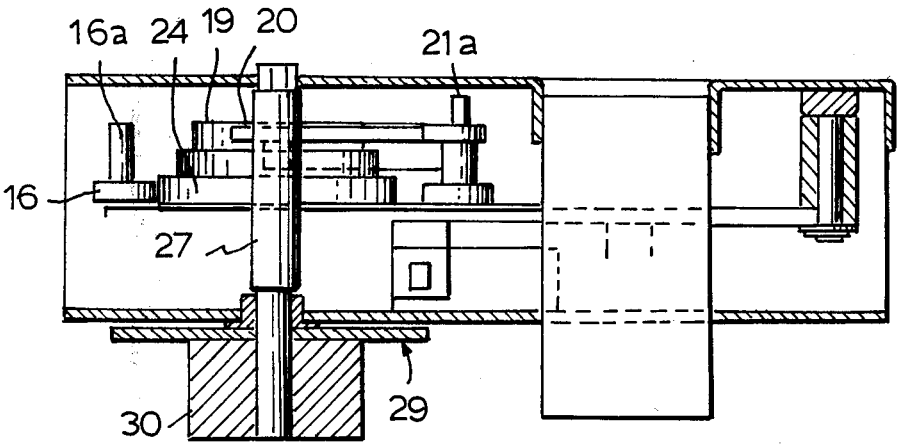
FIG. 5 is a plan view of the device of FIG. 2.

The counter mechanism 15 is constituted by a ratchet wheel 19, a ratchet pawl 20 engaged with said ratchet wheel 19, and a lever 21 pivotally supporting said ratchet pawl 20 on a pivot C and normally urged to a given position by a spring 28. Said lever 21 is also pivotally secured to the machine frame 9 by a pivot 21*a* and has a hooked portion 22 provided at an upper part thereof which engages a corresponding protuberance 23 provided on said actuating member 12 and has the upper end 21*b* of said lever 21 projecting above the top edge 12*a* of the actuating member 12 after the positional change thereof. Thus, when the actuating member 12 is in the position of FIG. 2 and the protuberant member 7 moves in a forward stroke with the slide frame 6*a* (movement to the right in FIG. 1) while sliding on the top edge 12*a*, said protuberant member 7 abuts the upper end 21*b* of said lever 21, causing the latter to turn clockwise about the pivot 21*a*. Accordingly, when the counter mechanism 15 is preset for the required number of copies the ratchet pawl 20 causes the ratchet wheel 19 to turn clockwise one pitch each time lever 21 is pivoted clockwise, whereby one reciprocation of the supporting member 6 is counted. A rotary disc 24 integral with the ratchet wheel 19 is rotatable about central shaft 27. This rotary disc 24 is provided with a protuberance 25 in a position such that when said disc 24 moves from the position of FIG. 2 to the position of FIG. 3, said protuberance 25 abuts against a corresponding protuberance 26 on the lever 16 to cause said lever 16 swing about the pivot 16*a* as shown in FIG. 3 to release the hook 17 from the protuberance 18. Said rotary disc 24 is rotatable with said ratchet wheel 19 by a knob 30 having a dial 29 thereon and mounted on shaft 27, as shown in FIG. 5, said dial 29 being graduated for indicating the number of copies. The desired number of copies can be set by manually turning said dial 29 by the knob 30.

The above-described embodiment of this invention operates as follows.

Figure 3:
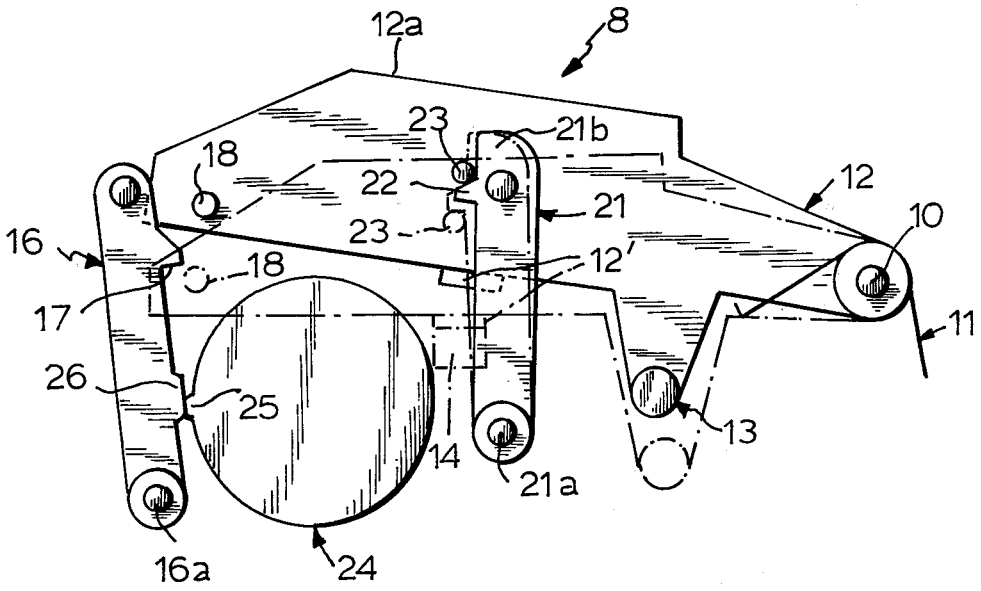
FIGS. 3 and 4 are views similar to FIG. 2 showing the operation of the switch device.
Figure 4:
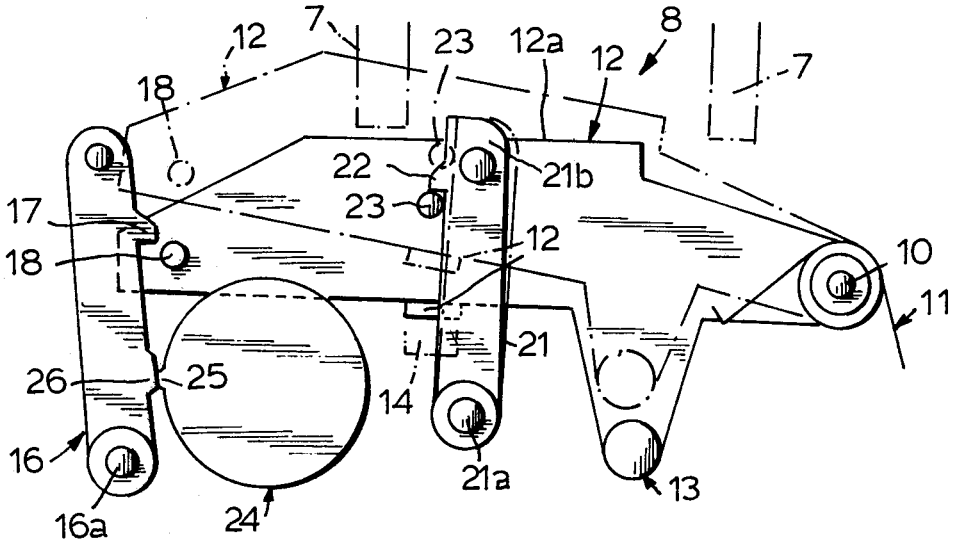

When the actuating member 12 is in the position shown by the solid lines in FIG. 3 and the dial 29 is set to move the protuberance 25 away from the protuberance 26 on the lever 16, the switch 14 is OFF and hence the supporting member 6 remains stationary. When the operating means 13 is pressed to change the position of the actuating member 12 to the position shown in FIG. 2, the lever 16 urged clockwise to engage the hooked portion 17 of the lever 16 with the protuberance 18, retaining the actuating member 12 in the FIG. 2 position. A part 12' of the actuating member 12 abuts the switch 14 to turn it ON, whereby a drive means (not shown) is driven to start the copying operation. The supporting member 6 begins to reciprocate at the start of the copying operation and each time the supporting member 6 returns, i.e. moves to the right in FIG. 1, the protrubence 7 on the slide frame **6*a* turns the lever 21 clockwise, as described above, whereby the ratchet pawl 20 is moved to turn the ratchet wheel 19, rotary disc 24 and dial 29, thus counting reciprocations (corresponding to the number of copies) of the supporting member 6**.

Figure 6:
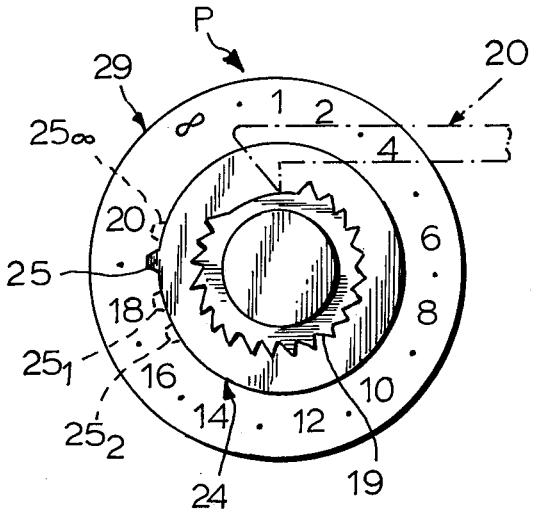
FIG. 6 is a schematic view illustrating the positional relation of the ratchet wheel, ratchet pawl, rotary member and dial.

When only one copy is desired the dial 21 is moved to bring the mark "1" into alignment with the datum point P (shown in FIG. 6) so that the protuberance 25 on the rotary disc 24 will be positioned as shown by the phantom line $25_1$ in FIG. 6. When the supporting member 6, after the copying operation is completed, comes to the vicinity of the termination of its return movement, i.e., the stop position, the protuberance 7 kicks the upper end **21*b* of lever 21 to turn the lever 21 clockwise. As a result, the ratchet pawl 20 is moved rightward in the drawing so as to turn the ratchet wheel 19 one pitch, and simultaneously the protuberance 25 on the rotary disc 24 is returned from the position 25, to the stop position shown by the solid lines in FIG. 6. The protuberance 25 reaches the aforesaid stop position and engages the protuberance 26 on lever 16, thereby turning the lever 16 counterclockwise to disconnect it from the actuating member 12. Then protruberance 7 on the supporting member 6 moves past the upper side 12*a* of actuating member 12, leaving it free to rise (see FIG. 3) whereby the switch 14** is turned OFF, thus stopping the supporting member in its rest position and shutting off the power supply to the drive means.

In addition, in the aforesaid embodiment one copy can be made even when the protuberance 25 is positioned as shown by the solid lines in FIG. 6. protruberance 22 on lever 21 will engage pin 23 to hold actuating member 12 against switch 14 for a single reciprocation of support 6. When it is desired to obtain two copies, dial 29 is moved to bring the number 2 of the graduations on the dial 29 into alignment with the datum point P and the above-said operations are repeated. When the protuberance 25 on the disc 24 comes to the position of shown by $25_1$ from the position $25_2$ shown by the phantom lines in FIG. 6, the first copying operation is completed, and when the disc 24 turns further upon completion of the second copying operation and the protuberance 25 thereof arrives at the full line position from the position $25_1$, the actuating member 12 is released in the manner described above and the copying operation is stopped. It is possible to obtain any desired number of copies in this way. (The shown embodiment is designed to allow 20 consecutive copying operations). For performing the copying operation continuously, mark ∞ on the graduation of the dial 29 is aligned with the datum point P. In this case, the protuberance 25 on the disc 24 stays at the position of 25 ∞ shown by the phantom lines in FIG. 6, and the ratchet wheel 19 has a cut out portion which is positioned at the point of engagement of the ratchet pawl 20. Therefore, when the copying operation is started with the parts in this position, the lever 21 turns to move the ratchet pawl 20 at copying operation, but because the pawl 20 is not engaged with any tooth of the ratchet wheel 19, both the ratchet wheel 19 and disc 24 remain stationary and hence the protuberance 25 does not move from the position of 25 ∞, allowing an unlimited number of copying operations.

Figure 7:
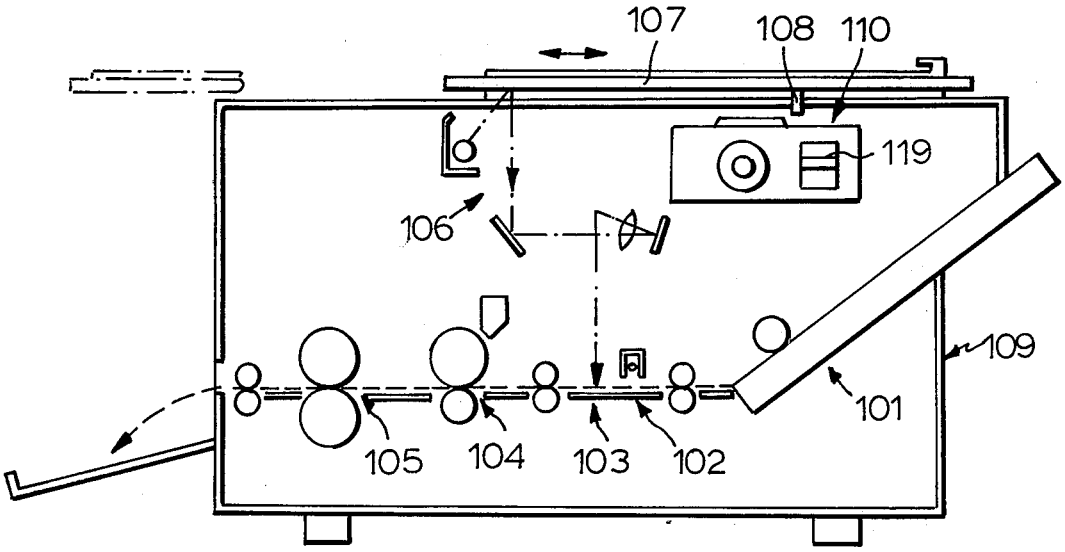
FIG. 7 is a schematic illustration of another electrostatic photographic copying machine utilizing the switch device according to this invention.

FIG. 7 is a schematic illustration of another type of electrostatic photo copying machine with which the switch device of the present invention can be used. The machine has a copying sheet feeding station 101, a charging station 102, an exposure station 103, a developing station 104, a fixing station 105, an optical system 106, a supporting member 107 for an original, an actuating element 108 provided on said supporting member 107 for operating the switch device of the present invention, a copying machine frame 109, and a switch device 110 according to this invention. This switch device is described in detail hereinbelow.

Figure 8:
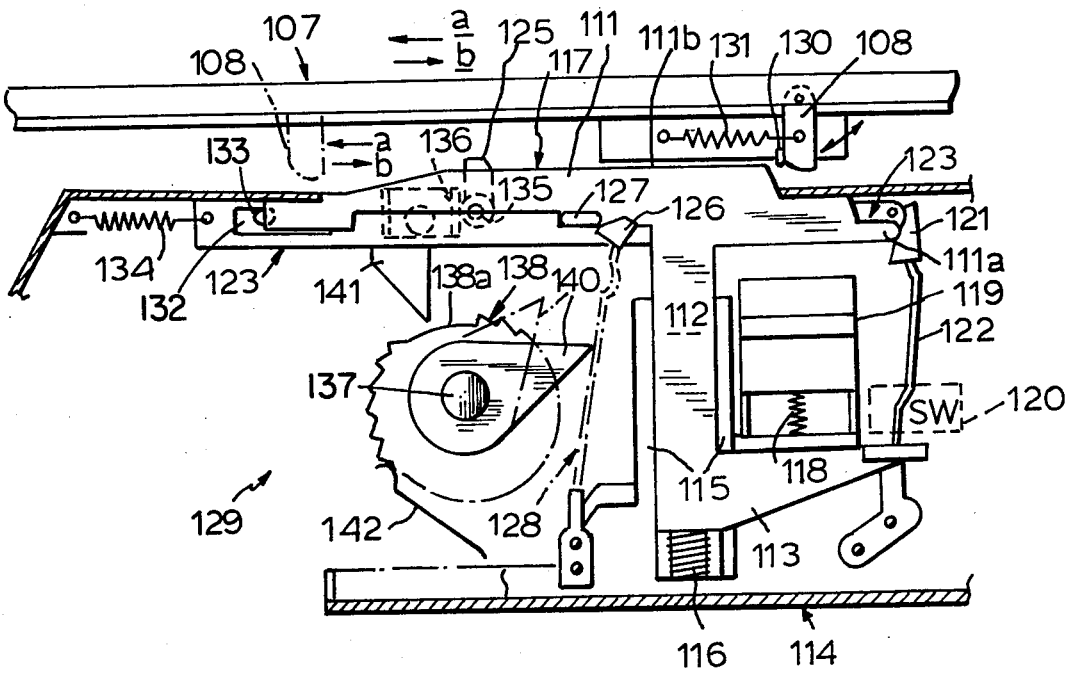
FIG. 8 is a front view of another embodiment of the switch device of the invention.
Figure 9:
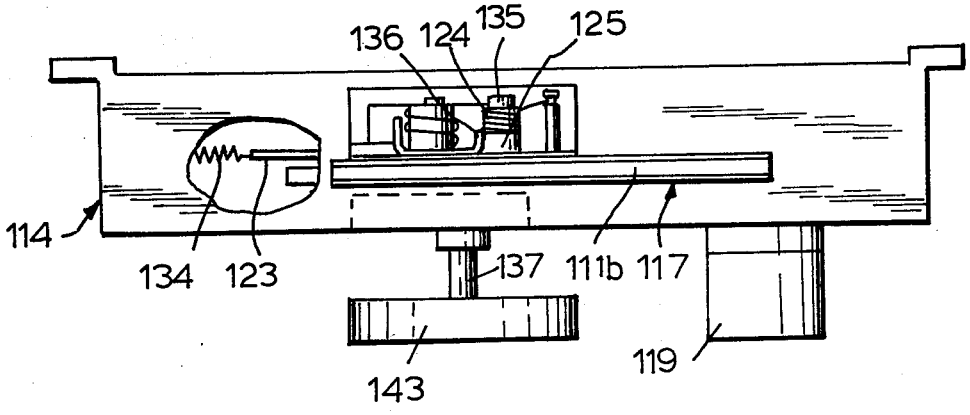
FIG. 9 is a plan view thereof.

As seen in FIG. 8, the switch device comprises a vertically movable plate 117, and operating means 119, a switch 120, a first spring member 122, and a horizontally movable plate 123.

The vertically movable plate 117 comprises an upper horizontal member 111, vertical member 112 and lower horizontal member 113, the vertical member 112 being vertically slidably supported by a guide 115 provided on a switch device mounting frame 114. The vertically movable member 117 is urged upwardly by a coiled spring 116 attached to the lower end of the guide 115.

The operating means 119 is provided on the mounting frame 114 between the lower horizontal member 113 and a portion of the upper horizontal member 111 opposed thereto so as to permit the vertically movable member to be vertically movable, and is supported at the position as shown in FIG. 8, by a coiled spring 118 inserted between the operating means 119 and the lower horizontal member 113. The operating means serves to lower the movable member by acting on the lower horizontal member 113 through the coiled spring 116 when copying is taking place.

The switch 120 is provided adjacent to the upper surface of lower horizontal member 113 on the vertically movable plate 117, whereby when the vertically movable plate 117 is lowered through the operative means 119, the switch 120 is released by the lower horizontal member 113 and is turned on to actuate the drive means in the machine, thereby starting the movement of supporting member.

The spring member 122 is fixed to the mounting frame 114 and is urged leftward in the drawing and has at the free end a retaining head 121, the head 121 being engagable with the free end **111*a* of the upper horizontal member 111 on the vertically movable plate 117 for holding the plate 117** in the lower position.

Figure 10:
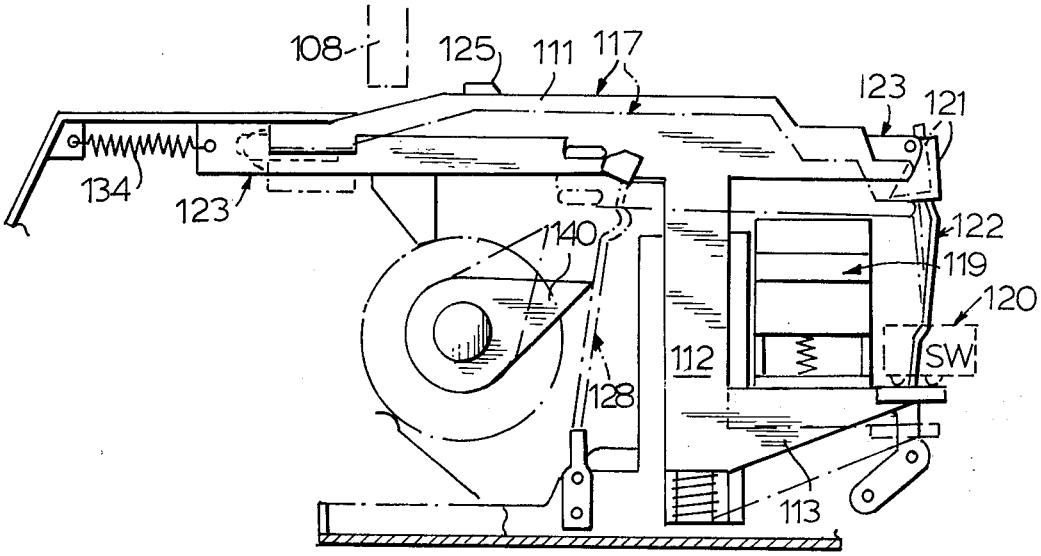
FIG. 10 is another front view thereof.

The horizontally movable plate 123 has a protuberance 125 pivotally mounted thereon on a pivot 135 and projecting upwardly from the upper surface thereof and held upright by a spring 124. The plate 123 is parallel to the upper horizontal member 111 on the vertically movable plate 117, and is supported on the mounting frame 114 so as to be movable leftward and rightward in the drawing. When the supporting member 107 moves rightward, the plate 123 is moved rightward by engagement of the actuating element 108 with the protuberance 125, and the free end pushes the retaining head 121 on the first spring member 122 out of engagement with the end 111*a* of member 111, thereby releasing the vertically movable plate 117 to permit it to be raised, for example, from the position shown by the dot and dash lines in FIG. 10 to the full line position.

The actuating element 108 is pivoted on the supporting member 107 and when it projects downwardly is slidably contacted with the upper surface 111*b* of the upper horizontal member 111 on the vertically movable plate 117. It is also blocked against clockwise rotation from the vertical position by a stop 130 shown in FIG. 8 and is able to turn only in the counterclockwise direction. After a counterclockwise turn, it is returned to said vertical position by a spring 131.

The horizontally movable plate 123 is movably supported on the mounting frame 114 which is secured to the mounting frame 114 and fitted in an elongated slot 132 formed at the opposite end of the plate from the end engaged to head 121 and by a guide portion (not shown) on the mounting frame 114 at the end of the plate near the head 21. Said plate 123 is normally pulled leftwardly in FIG. 8 by a spring 134 connected to the left end of the plate. The protuberant element 125 is always held in the upwardly projecting position by a stop 136 and the spring 124. It cannot turn counterclockwise in FIG. 8. On the return movement of the actuating element 108, said protuberant element 125 is engaged by the element 108 to more the horizontally movable plate 123 to the right, and when the end of the elongated slot 132 abuts the pin 133 the protuberance 125 is turned clockwise against the spring 124 urging the protuberance 125 to the vertical position, thereby allowing the actuating element 108 to pass the protuberance 125.

The operation of the device for performing a copying operation starting from the condition of FIG. 8 will be described. In this condition, the actuating element 108 is at the stationary position as shown and the vertically movable plate 117 is in the upper position and the switch 120 is OFF. The second spring member 128 is inclined rightward, with the head 126 disengaged from the protuberance 127. Thus, when the operating means 119 is depressed to lower the vertically movable plate 117 against the force of spring 116, the switch 120 is turned ON to connect the power source to the drive means, and the first spring member 122 swings from the solid line position to the phantom line position in FIG. 10 and the engaging head 121 is engaged with the rear end of the upper horizontal member 111 to thereby hold the plate 117 in the lower position by the phantom lines in FIG. 10. At this time, the horizontally movable plate 123 is held in the forward position, namely to the left in the drawing, by the action of the spring 134. Upon actuation of the switch 120, the supporting member 107 begins to move in the direction of arrow a in FIG. 8 to start the copying operation. One copying operation is completed at the end of one reciprocation, that is, forward movement in the direction of arrow a and return movement in the direction of arrow b, of the supporting member 107. During the movement in the direction of arrow a, that is, forward movement, the actuating element 108 abuts the protuberance 125 but said element 108 itself is turned counterclockwise and exerts no force on the protuberance 125. On the other hand, when the supporting member 107 makes its return movement, i.e. movement in the direction of arrow b, said element 108 abuts the protuberance 125 and pushes it rearwardly (to the right in the drawing), causing corresponding movement of the horizontally movable plate 123 in the same direction, and when this plate 123 arrives as its rightmost position, the rear end thereof pushes the engaging head 121 of the first spring member 122 to the right, whereby said head 121 is disengaged from the upper horizontal member 111 of the vertically movable plate 117 and consequently the vertically movable plate 117 which has been held in its lower position is pushed up by the force of the spring 116. The actuating element 108 abuts not only the protuberance 125 but also the top face 111*b* of the upper horizontal member 111 of the vertically movable plate 117 and slides on said top face 111*b*, so that even when the first spring member 122 is disengaged said plate 117 does not rise all the way to its upper position, and hence the switch 120 stays ON. When the supporting member 107 moves further rightward the end wall of slot 132 abuts the pin 133 and the force of the spring 124 urging the protuberance 125 is overcome and the protuberance 125 turns clockwise to permit the actuating element 108 to pass over it, and the actuating element 108 passes the top face 111*b* of the upper horizontal member 111 so as to be no longer engaged therewith, whereupon the plate 117 is allowed to rise to the original position and the switch 120 is turned OFF to stop the supporting member 107 at the stop position of FIG. 8.

The foregoing description is for the case where only one copying operation is performed, that is, when only one copy is obtained. Described in the following are the arrangement and operation for obtaining multiple copies.

Figure 11:
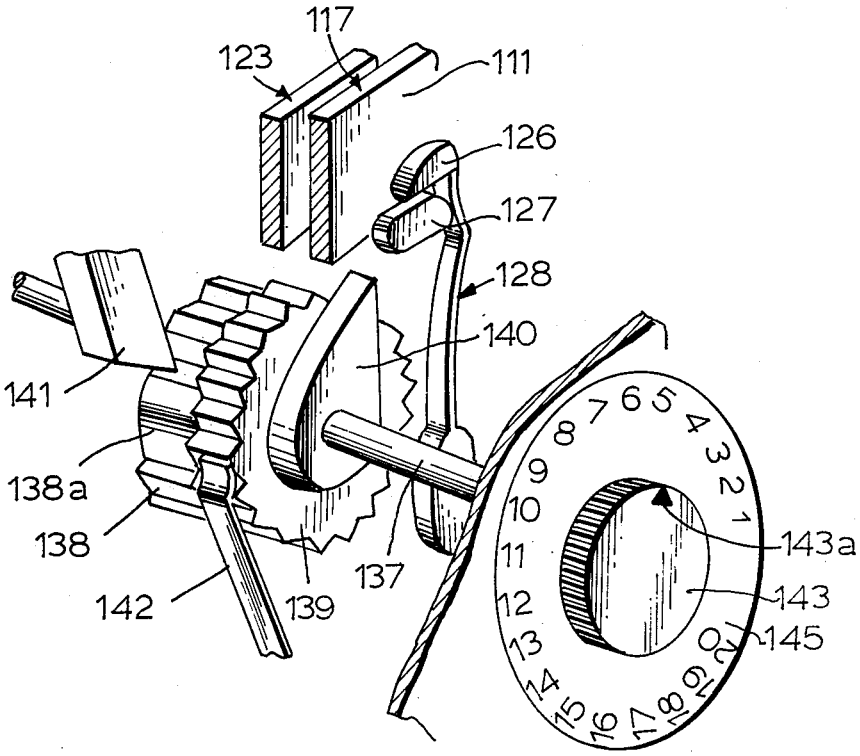
FIG. 11 is a perspective view of a counter mechanism.

For obtaining multiple copies, there is provided a continuous copying mechanism comprising a counter mechanism 129 and a second spring member 128 adapted to hold the vertically movable plate 117 in its lower position even when the first spring member 122 is disengaged. Said counter mechanism 129, as shown in FIG. 11, comprises a shaft 137 rotatably supported on the mounting frame 114, a ratchet wheel 138, a counter gear 139 and a cam 140 which are fixedly mounted on said shaft 137 and integrally engaged with each other, a ratchet pawl 141 provided on the horizontally movable plate 123 and meshable with said ratchet wheel 138, and a rebound leaf spring 142 secured to the mounting frame 114 and engaged with said counter gear 139. The ratchet pawl 141 is blocked against rotation in the clockwise direction in the drawing but is able to turn counterclockwise, and when the horizontally movable plate 123 is moved by the actuating element 108 during the return movement of the supporting member 107, said ratchet pawl 141 is meshed with the ratchet wheel 138 to turn said wheel 138 clockwise pitch by pitch, thereby counting every reciprocation of the supporting member 107 carrying the original document. On the end of the shaft 137 is mounted a counter dial knob 143 disposed in the center of to a graduated circular plate 145 carrying indications of the number of copies to be obtained and fixed to the front plate 144 of the mounting frame 114. Any desired number of cycles of the copying operation can be set by turning said dial knob 143 by hand. Said cam 140 is integral with the ratchet wheel 138 and counter gear 139 so that they will turn together. Just before the last copy of a given number (for example the 20th of 20 sheets) is finished and the supporting member is returned the stop position, the tip of cam 140 hits the second spring member 128 to move it to the right, thereby disengaging the head 126 from the protuberance 127. When the actuating element 108, leaves the upper surface 111*b* of upper horizontal member 111 as described above the vertically movable plate 117 is raised to the uppermost position. In the case of a single copying operation, the cam 140 and ratchet wheel 138 are at the positions shown by the solid lines in FIG. 8, that is, the flat portion 138*a* of the ratchet wheel 138 is at the position of engagement with the ratchet pawl 141, and at this position the wheel 138 is not advanced by the pawl 141. Also, the pointed end of the cam 140 pushes the second spring member 128 to hold it disengaged from the protruberance 127 on the vertically movable plate 117.

When it is desired to obtain five copies, the counter dial knob 143 is turned to set the datum point 143*a* at "5" on the graduated plate 145 (see FIG. 11). By this action, the shaft 137 is turned counterclockwise to move the cam 140 to the position of phantom line in FIG. 8. At this stage, the engaging head 126 of the second spring member 128 is not engaged with the protuberance 127 on the vertically movable plate 117. When the operating means 119 is depressed to lower the vertically movable plate 117, said protuberance 127 slides down along the bevelled surface of said engaging head 126 and the head 126 is engaged therewith, and the vertically movable plate 117 is thus held in the lowered position by said second spring member 128. At this time, of course the first spring member 122 is also holding said plate 117 down. Upon the descent of the vertically movable plate 117, the switch 120 is released so that it is turned ON to actuate the drive (not shown) and cause the supporting member 107 start its reciprocative movement to perform the copying operation. During the copying operation for the first to fourth sheet, even though cam 140 is indexed clockwsie one place for each reciprocation, it does not engage spring member 128, and the vertically movable plate 117 is held in position by the secnd spring member 128, so that during this period said plate 117s will not rise even if the horizontally movable plate 123 is freed from engagement with the first spring member 122.

Just before 5th copy is finished and the supporting member 107 returns to its stop position, the actuating element 108 abuts the protuberance 125, whereby the counter mechanism 129 is actuated to return the cam 140 through its last indexing movement to the position where it engages the second spring 128 to move the second spring 128. Hence, the second spring 128 is now disengaged from protuberance 127. Furthermore the actuating element 108 and protuberance 125 move the horizontally movable plate 123 rightward, thereby releasing the head 121 of the first spring 122 from the free end 111*a*. When the supporting member 107 moves further and the actuating element 108 leaves the upper surface 111*b* of upper horizontal member 111 the vertically movable plate 117 rises and engages the switch 120 to turn it OFF, whereby the drive stops and the supporting member 107 comes to rest at the original position.

While the above-described embodiment is for an electro photographic copying machine employing a moving supporting member for an original, the invention is of course applicable to a copying machine having a moving optical system.

The switch device of the invention, which is mechanically constituted as described above, is capable of simply starting movement of the movable members and reliably holding the movable members in position, so that the drive is actuated only by moving the movable members, thereby saving consumption of power. Also, the switch device is reliable and simple in operation and structually simplified, resultingd in less failure and a lower manufacturing cost.

We claim:

1. A switch device for an electrostatic photographic copying machine having a reciprocally movable member reciprocating from a rest position and returning thereto during each copying operation of the copying machine, and drive means driving the movable member, said switch device comprising:

an actuating member movable relative to the copying machine body and means operatively associated with said actuating member for urging it toward a non-operating position;

an operating means engagable with said actuating member for moving said actuating member to an operating position;

a retaining means engagable with said actuating member for holding said actuating member in the operating position after it has been moved to the position;

a switch means for actuating the drive means for the movable member and engagable by said actuating member for actuating said switch means for actuating the drive means when said movable member is in the operating position an actuating said switch means for deactuating the drive means when the movable member is in the non-operating position; and a protuberant member movable with said reciprocally movable member and engaging said retaining means just prior to the return of said reciprocally movable member to the rest position after a reciprocating movement thereof for disengaging said retaining means from said actuating member, whereby when said retaining means is disengaged said actuating member is free to be moved to the non-operating position for actuating the switch means for deactuating the drive means.

2. A switch device as claimed in claim 1 further comprising a counter mechanism for counting the number of times said reciprocally movable member reciprocates, a further retaining means engagable with said actuating member for holding said actuating member in the operating position after it has been moved to the operating position, said counter mechanism being engagable with said further retaining means after it has counted the desired number of reciprocations of said reciprocally movable member for disengaging said further retaining means from said actuating member.

3. A switch device as claimed in claims 1 or 2, wherein said actuating member is a plate member swingably pivoted with respect to the copying machine body.

4. A switch device as claimed in claims 1 or 2, wherein said actuating member is a plate vertically movably supported on the copying machine body, and said means for urging said actuating member to the non-operating position is a spring connected to said plate.

5. A switch device as claimed in claims 1 or 2, wherein said retaining means is a swingable lever having a hooked portion, and said actuating member has a protuberance thereon engaged by said retaining means for holding said actuating member in the operating position.

6. A switch device as claimed in claims 1 or 2, wherein said retaining means is a spring member having a retaining head at the free end thereof, and said actuating member has a protuberance thereon engaged by said retaining means for holding said actuating member in the operating position.

7. A switch device as claimed in claim 1 wherein said counter mechanism comprises a ratchet pawl connected to said first pivoted retaining lever and actuated for every reciprocation of said reciprocally movable member, a ratchet wheel engaged by said pawl, and a cam driven by said ratchet wheel engaged by said pawl, and a cam driven by said ratchet wheel and engaged with said second pivoted retaining lever.

8. A switch device for an electrostatic photographic copying machine having a reciprocally movable member reciprocating from a rest position and returning thereto during each copying operation of the copying machine, and drive means driving the movable member, said switch device comprising:

a vertically movable plate movable relative to the copying machine body and a spring connected with said plate for urging the plate to an upper non-operating position;

an operating means engagable with said plate for moving said down to an operating position against the action of said spring;

a first spring member engagable with said plate for holding said plate in the operating position after it has been lowered;

a switch for actuating the drive means for the movable member and engagable by said plate for actuating said switch for deactuating the drive means when said plate member is in the upper position and actuating said switch for actuating the drive means when the movable member is in the lowered position;

a horizontally movable member supported on the copying machine body and horizontally movable for engaging said first spring member for disengaging it from said plate; and a protuberant member movable with said reciprocally movable member and engaging said horizontal plate for moving it to engaging said first spring member just prior to the return of said reciprocally movable member to the rest position after a reciprocating movement thereof, whereby when said first spring is disengaged said plate is free to be moved to the upper position for actuating the switch for deactuating the drive means.

9. A switch device as claimed in claim 8 further comprising a second spring member having at its upper end an engaging head engagable with said vertically movable plate for holding said vertically movable plate in the lowered position, and a counter mechanism for counting the number of reciprocations of said reciprocally movable member and engaging said second spring member for disengaging it after a desired number of reciprocations have been counted.

10. A switch device as claimed in claim 9, wherein said counter mechanism comprises a ratchet pawl on said horizontally movable plate, a ratchet wheel position engaged by said pawl, and a counter gear on said ratchet wheel and having a cam thereon for engaging said second spring member.

11. A switch device for an electrostatic photographic copying machine having a reciprocally movable member reciprocating from a rest position and returning thereto during each copying operation of the copying machine, and drive means driving the movable member, said switch device comprising:

a pivotally mounted plate movable relative to the copying machine body and a spring engaged with said plate for pivoting it toward a non-opeating position;

an operating means engagable with said plate for pivoting said plate to an operating position;

a first pivoted retaining lever spring loaded into engagement with said plate for holding said plate in the operating position after it has been moved to the generating position;

a switch for actuating the drive means for the movable member and engagable by said plate for actuating said switch for actuating the drive means when said movable member is in the operating position and disengable from said switch for actuating the drive means when the movable member is in the non-operating position; and a protuberant member movable with said reciprocally movable member and engaging said retaining lever just prior to the return of said reciprocally movable member to the rest position after a reciprocating movement thereof for disengaging said retaining lever from said plate, whereby when said retaining means is disengaged said plate is free to be moved to the non-operating position for engaging the switch for deactuating the drive means.

12. A switch device as claimed in claim 11, further comprising a second pivoted retaining lever spring loaded into engagement with said plate for holding said plate in the operating position after it has been pivoted to the operating position, and a counter mechanism for counting the number of reciprocations of said reciprocally movable member and engaging said second pivoted retaining lever for disengaging it after a desired number of reciprocations have been counted.

* * * * *